US008844329B2

(12) United States Patent
Anderson

(10) Patent No.: US 8,844,329 B2
(45) Date of Patent: Sep. 30, 2014

(54) SECURITY DEVICE FOR ELECTRONIC COMPONENTS

(76) Inventor: Scott Anderson, Nashua, NH (US)

( * ) Notice: Subject to any disclaimer, the term of this patent is extended or adjusted under 35 U.S.C. 154(b) by 0 days.

(21) Appl. No.: 12/655,857

(22) Filed: Jan. 6, 2010

(65) Prior Publication Data

US 2010/0170304 A1 Jul. 8, 2010

Related U.S. Application Data

(60) Provisional application No. 61/204,291, filed on Jan. 6, 2009.

(51) Int. Cl.
*E05B 73/00* (2006.01)

(52) U.S. Cl.
CPC ..... *E05B 73/0005* (2013.01); *E05B 73/0082* (2013.01); *Y10S 70/09* (2013.01)
USPC ..... 70/14; 70/49; 70/58; 70/DIG. 9

(58) Field of Classification Search
CPC . E05B 73/0082; E05B 73/0005; E05B 73/00; E05B 2073/0088
USPC ..... 70/58, 14, 16, 18, 19, 49, 57, DIG. 9; 248/551–553; 361/679.57, 679.58
See application file for complete search history.

(56) References Cited

U.S. PATENT DOCUMENTS 3,206,959 A * 9/1965 Best ..... 70/373
3,643,810 A * 2/1972 Highberger ..... 211/70.5
3,859,826 A * 1/1975 Singer et al. ..... 70/58
4,003,228 A * 1/1977 Lievens et al. ..... 70/58
4,004,440 A * 1/1977 Dreyer ..... 70/15
4,055,973 A * 11/1977 Best ..... 70/58
4,527,405 A * 7/1985 Renick et al. ..... 70/14
4,680,949 A * 7/1987 Stewart ..... 70/14
4,924,683 A * 5/1990 Derman ..... 70/14
4,964,286 A * 10/1990 Poyer ..... 70/58
5,502,989 A * 4/1996 Murray et al. ..... 70/58
5,832,754 A * 11/1998 McKenzie ..... 70/58
5,875,657 A * 3/1999 Kelley ..... 70/18
5,907,962 A * 6/1999 Smithson et al. ..... 70/58
6,058,744 A * 5/2000 Ling ..... 70/28
6,105,922 A * 8/2000 Derman ..... 248/551
6,257,029 B1 * 7/2001 Liao ..... 70/58
6,349,575 B1 * 2/2002 Bentley ..... 70/18
6,601,416 B1 * 8/2003 Sanders ..... 70/58
6,918,272 B1 * 7/2005 Sanders ..... 70/58
7,234,326 B1 * 6/2007 Lu ..... 70/58
7,249,474 B2 * 7/2007 Avganim ..... 70/14
7,302,816 B1 * 12/2007 Lu ..... 70/58
7,308,809 B2 * 12/2007 Lu ..... 70/58
7,549,308 B2 * 6/2009 Avganim ..... 70/58

(Continued)

*Primary Examiner* — Lloyd Gall
(74) *Attorney, Agent, or Firm* — Lambert & Associates; Gary E. Lambert; David J. Connaughton, Jr.

(57) ABSTRACT

A locking cable device which inhibits the theft of computer equipment. The security device combines a scissor clip designed to connect to the built-in security slot in computer equipment, a cable, and a lock. They are combined by way of a dual-action lock, with the first action capable of engaging and disengaging the scissor clip from the computer equipment, and the second action capable of separately disengaging the security cable to allow it to pass through other equipment or fasteners to allow the device to secure multiple pieces of computer equipment.

3 Claims, 3 Drawing Sheets

(56) References Cited

U.S. PATENT DOCUMENTS

| | | | | |
|---|---|---|---|---|
| 7,565,824 | B1 * | 7/2009 | Gleason | 70/58 |
| 7,614,264 | B2 * | 11/2009 | McGettrick | 70/14 |
| 2002/0056295 | A1 * | 5/2002 | Huang | 70/58 |
| 2005/0178172 | A1 * | 8/2005 | McGettrick | 70/58 |
| 2005/0204786 | A1 * | 9/2005 | Meyer et al. | 70/58 |
| 2007/0271971 | A1 * | 11/2007 | Johnson | 70/58 |
| 2010/0180648 | A1 * | 7/2010 | Knox | 70/58 |

* cited by examiner

SECURITY DEVICE FOR ELECTRONIC COMPONENTS

CROSS REFERENCE TO RELATED APPLICATION

This application takes priority from and claims the benefit of Provisional Application Ser. No. 61/204,291 filed on Jan. 6, 2009, the contents of which are hereby incorporated by reference.

FIELD OF INVENTION

The present invention relates generally to security systems, security systems for small electronic equipment or systems, and in particular to security systems for computers.

BACKGROUND OF THE INVENTION

The present invention relates to anti-theft devices for deterring the theft of smaller, yet expensive pieces of equipment, particularly electronic systems. Numerous devices have been developed to assist in preventing the theft of computers and other smaller electronic equipment. Since many systems requiring security measures comprise several items, i.e. a CPU, a monitor and a printer, etc., needed security devices often utilize a cable which connects each of the components to each other and/or to a relatively immovable object such as a desk.

In recent years, most computer manufacturers regularly incorporate some attachment method for security devices. This practice began on some of the earliest computer models, wherein several different sized security slots (not shown as these slots are regularly known in the art) were designed to accept "snap-in" security attachments that would then allow a security cable to pass through that attachment. Additionally, some manufacturers have provided reversible brackets disposed within the computer chassis in order to allow the user to remove the computer cover and turn the bracket around for use with a security cable.

Moreover, other systems possess regular chassis screws that were secured by use of "screw-on" fasteners which in turn security cables were passed through, in order to prevent unscrewing the fastener and thus secure the equipment. Over years of ever evolving design changes, presently, most manufacturers of computer equipment provide a bracket designed to protrude from the chassis of the computer with a hole that a security cable can pass through, or they provide a small security slot in the exterior wall.

Many different security devices have been developed over the years to fit into this security slot. The majority of the manufacturers of these security devices for the last two decades have made a 3-piece security kit containing a scissor clip which has two opposing hooks that attach into the security slot, a security cable to attach the equipment to a desk or table, and a lock to secure them together.

Therefore, for many years there have been two main systems existing for securing computers and laptops. Specifically, there exist three piece kits (a scissor-clip, a steel cable, and a locking mechanism) and one piece kits (a steel cable with a permanently attached lock and locking method). Customers had to choose between the drawbacks of a one piece security kit (not very secure with a far weaker attachment method that can be broken off by hand, and only has the ability to secure one piece of equipment with one lock) and the drawbacks of a 3-piece kit (far more of a hassle to install, and too easy to lose the small scissor clip when not locked onto the equipment).

SUMMARY OF THE INVENTION

The instant invention, as described further herein, imparts a security system for small electronic equipment or systems. As illustrated herein, the introduced system is neither anticipated, nor rendered obvious or present in any of the prior art methods, neither alone nor in any combination thereof. A primary object of the instant invention is to provide a security system for computers.

The current system illustrates a security system for computers that seamlessly incorporates a scissor clip mechanism, a locking mechanism and joining mechanism in a manner such that the scissor clip mechanism remains attached to the cable mechanism, yet allows the joining mechanism, such as a cable or linkage as known in the art, to be user detached, in order to run the cable mechanism through other equipment or security fasteners. Therefore for the first time a customer can get the strength of the steel scissor clip, the convenience of a 1-piece kit, the versatility and economy of being able to secure multiple pieces of technology equipment with one lock, the universality of one kit to secure either a laptop or a desktop and monitor as needs change, and the ability to latch into multiple sizes and shapes of security slots and holes.

It is understood that existing security kits utilizing scissor clips, cables, and locking mechanisms can be connected together by utilizing the locking mechanisms. Normally, however, in that scenario the scissor clip must be removed from the connection in order to be inserted into the security slot of the equipment. Conversely, the instant apparatus allows for connection of the scissor clip to the cable and the locking mechanism in a way that does not require it to be disconnected to insert it into the security slot.

The scissor clip is attached to the lock in a way that will prevent it from falling off of the lock and getting lost. The scissor clip has an open position and a closed position. When the scissor clip is in the open position, it can be inserted and removed from the security slot. When the scissor clip is in the closed position it cannot be removed from the security slot. The scissor clip is attached to the lock in a way that does not prevent the scissor clip from opening or closing when the first lock action is in the unlocked position, and does prevent the scissor clip from opening when the first lock action is in the locked position. The scissor clip is also attached to the lock in a way that it cannot be removed from the lock while the first lock action is in the locked position. The cable is attached to the lock in a way that it cannot be removed when the second lock action is in the locked position, and can be removed when the second lock action is in the unlocked position.

There has thus been outlined, rather broadly, the more important features of the security device for electronic components in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are used for descriptive purposes, and should not be regarded as limiting.

The following drawings are for the purpose of illustration only and are not intended to define the limits of the invention.

DESCRIPTION OF THE SEVERAL EMBODIMENTS

Figure 1A:
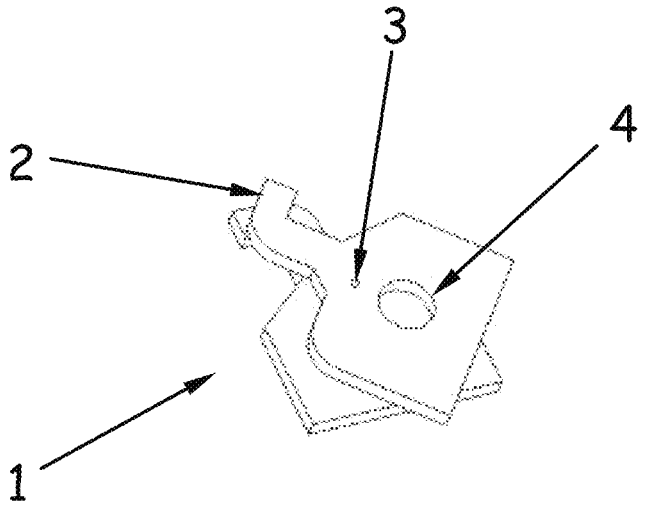
FIG. 1A is a perspective view of the scissor clip mechanism, illustrated herein disposed in the open position, wherein scissor clip mechanism is designed to communicate with a security hole prefabricated within the side of electronic equipment, such as computers.
Figure 1B:
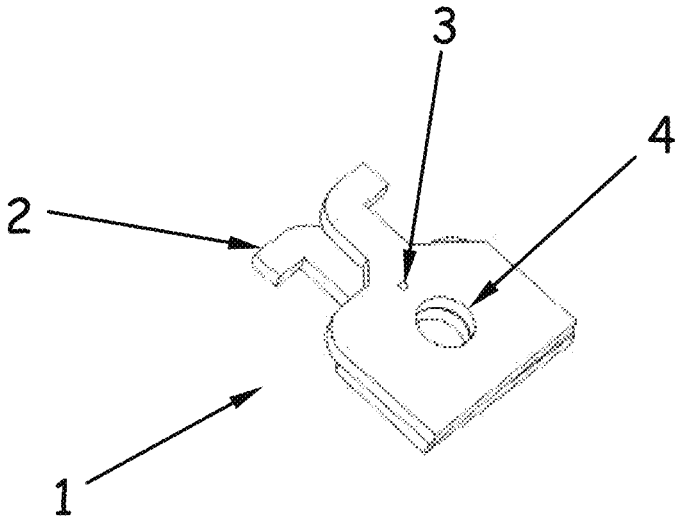
FIG. 1B illustrates the scissor clip mechanism from FIG. 1A, actuated into the closed or locking position. Once in this position, the scissor clip mechanism cannot be removed from said security hole prefabricated within the side of electronic equipment without moving back into the position shown in FIG. 1A.
Figure 2:
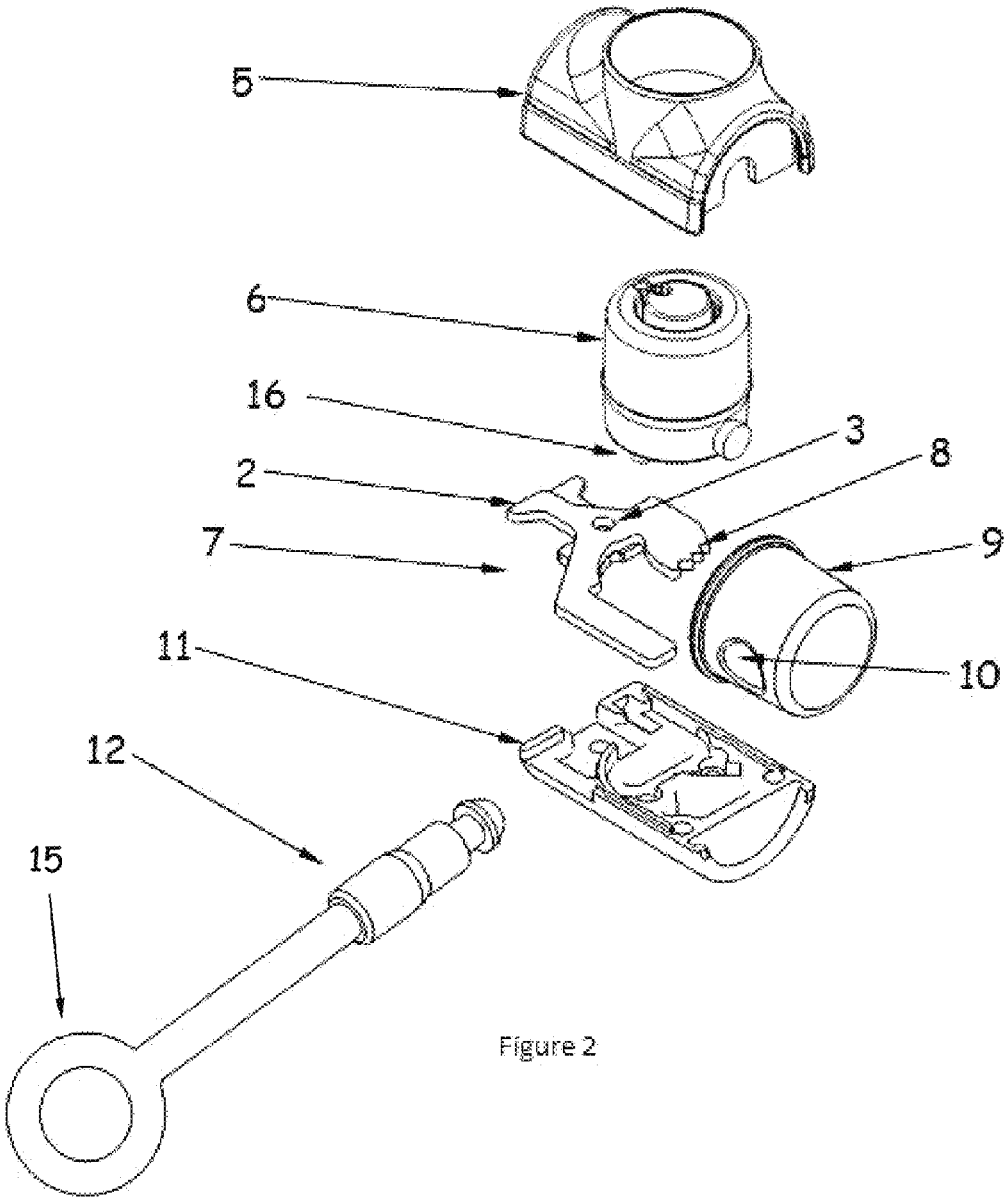
FIG. 2 is an exploded perspective view one embodiment of the present system wherein the scissor clip mechanism is permanently installed inside of the locking mechanism, between the top and bottom covers of the locking mechanism.

As illustrated in FIGS. 1A-3A, the object of the instant system comprises an apparatus and method of securing electronic components, attaching a scissor clip mechanism 1 or 7, a lock 13 and a security joining mechanism or cable mechanism 12. The instant system allows for ease of use of the intermingled components and protects the components from getting misplaced.

One critical element of the present system comprises the removably attachable nature of the security cable 12 from the lock 13. This can be accomplished-by use of a key mechanism (not shown) 4-4. This is a significant improvement of the invention over existing cable locks, as it is the only "single-piece" computer lock that can also detach the security cable 12 from the lock 13 so that the security cable 12 can be used to secure multiple pieces of equipment, whether the pieces of equipment have built-in or add-on security fasteners, apertures, or slots, and then the security cable 12 can be locked back into the lock 13 by inserting it into the aperture 10 of the cable trap section 9 of the lock 13.

In general, the security cable 12 is attached at the other end to an immovable object such as a desk, beam, or pole. This attachment is accomplished by means well known in the art such as a loop on the other end of the cable, or by the use of fasteners. The lock cylinder 6 part of the lock 13 is a dual-action lock cylinder 6 so that activating the first action will release the scissor clip 7 and allow it to open and be removed from the security slot of the protected computer equipment. In this embodiment the first action is accomplished by turning the key (not shown) in one direction. The second action of the lock cylinder 6 will release the security cable 12 from the cable trap section 9 of the lock 13. In this embodiment the second action is accomplished by turning the key in the other direction.

Figure 3A:
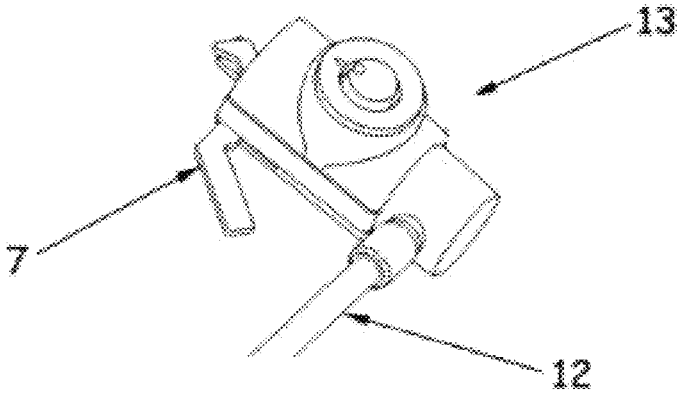
FIG. 3A is a perspective view of the present system wherein the scissor clip mechanism is in the open position; and, FIG. 3B is a perspective view of the present system wherein the scissor clip mechanism is in the closed position.
Figure 3B:
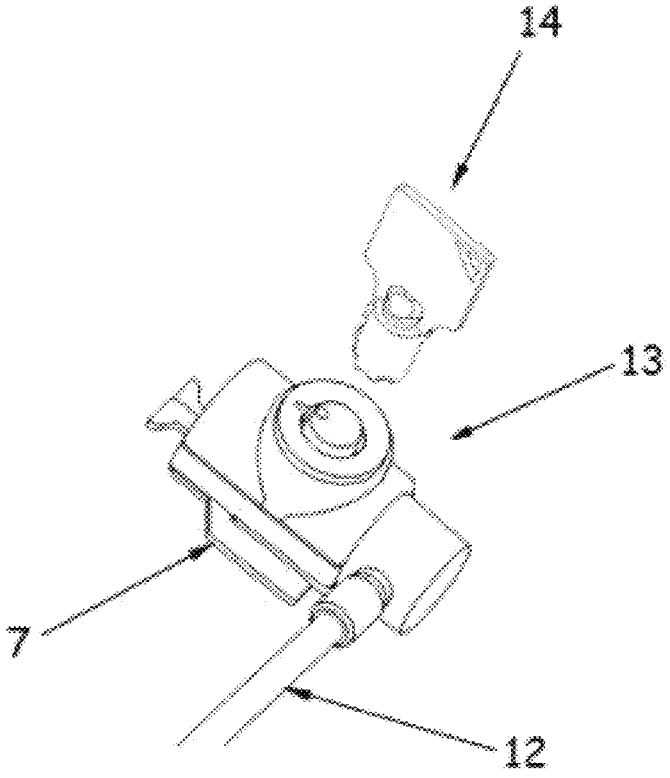

The scissor clip mechanism 1 or 7 may be permanently or removably attached to the lock 13 as long as the scissor clip mechanism 1 or 7 cannot be moved from the closed position of FIG. 3B to the open position of FIG. 3A without first unlocking the lock.

In this embodiment, the scissor clip mechanism 7 is permanently attached to the lock 13 by being installed inside of the lock 13 between the top cover 5 and the bottom cover 11. In this embodiment, the scissor clip mechanism 7 is installed beneath the lock cylinder 6 so that the cylinder can hold the scissor clip mechanism 7 in one of several ratcheting positions via a pawl 16 on the bottom of the lock cylinder 6. The preferred embodiment of the scissor clip mechanism 7 can ratchet lock into multiple positions between the fully open position of FIG. 3A to the fully closed position of FIG. 3B by means of the ratcheting teeth 8 on the scissor clip 7 interfacing with the pawl 16 of the lock cylinder 6. The pawl 16 is released when the first action of the dual-action lock cylinder 6 is activated. This allows it to fit into multiple sizes and shapes of security holes. Moreover, the mechanism for attaching the series of equipment may include a loop 15 on the end of the security cable 12 and thus upon the security cable 12 being run through the entirety of the equipment, to link the equipment, the security cable 12 is passed through the loop 15 and sent to the lock 13.

While one embodiment of the present invention has been illustrated by way of example, it is apparent that further embodiments could be developed within the spirit and scope of the present invention. It is to be expressly understood that such modifications and adaptations are within the spirit and scope of the present invention, as set forth in the following claims.

What is claimed is:

1. A security system for electronic equipment comprising:

a lock having a cable trap section and a lock cylinder;

a security cable received and locked by an aperture defined by the cable trap section;

a ratcheting scissor clip mechanism attached to the lock, engaged to a security slot defined by the electronic equipment when the scissor clip mechanism is in a closed position and removable from the security slot when the scissor clip mechanism is in an open position; and the lock cylinder having a locked position that locks the security cable in the cable trap section aperture and simultaneously secures the scissor clip mechanism in the closed position, a first lock cylinder action that allows the scissor clip mechanism to be in the open position, and a different lock cylinder second action that unlocks the security cable from the cable trap section.

2. The security system of claim 1 wherein the scissor chip mechanism is capable of remaining locked in the closed position when the lock cylinder is under the second action.

3. The security system of claim 1 wherein the security cable is capable of being locked in the cable trap section aperture when the lock cylinder is under the first action.

* * * * *